US012760499B2

(12) United States Patent
Maruyama et al.

(10) Patent No.: US 12,760,499 B2
(45) Date of Patent: Oct. 13, 2026

(54) WORKING VEHICLE

(71) Applicant: TAKEUCHI MFG. CO., LTD., Hanishina-gun (JP)

(72) Inventors: Shota Maruyama, Hanishina-gun (JP); Hidaka Oyama, Hanishina-gun (JP)

(73) Assignee: TAKEUCHI MFG. CO., LTD., Hanishina-gun (JP)

( * ) Notice: Subject to any disclaimer, the term of this patent is extended or adjusted under 35 U.S.C. 154(b) by 253 days.

(21) Appl. No.: 18/223,129

(22) Filed: Jul. 18, 2023

(65) Prior Publication Data

US 2024/0287760 A1 Aug. 29, 2024

(30) Foreign Application Priority Data

Feb. 27, 2023 (JP) ..... 2023-027880

(51) Int. Cl.
*E02F 9/18* (2006.01)

(52) U.S. Cl.
CPC ..... *E02F 9/18* (2013.01)

(58) Field of Classification Search
None
See application file for complete search history.

(56) References Cited

U.S. PATENT DOCUMENTS

| | | | | |
|---|---|---|---|---|
| 6,499,556 | B1 | 12/2002 | Koyama | |
| 9,067,521 | B1 * | 6/2015 | Masanek, Jr. | B65D 11/22 |
| 2013/0078071 | A1 * | 3/2013 | Noguchi | B60K 1/04 414/719 |

FOREIGN PATENT DOCUMENTS

| | | | |
|---|---|---|---|
| EP | 2584101 | A1 | 4/2013 |
| JP | 2015-140641 | A | 8/2015 |
| JP | 7025226 | B2 | 2/2022 |
| KR | 10-0723582 | B1 | 6/2007 |
| WO | 2016/080340 | A1 | 5/2016 |

OTHER PUBLICATIONS

Kamekura JP5431103B2 "Counterweight for Construction Machine", Mar. 5, 2014, all pages. (Year: 2014).*
Extended European Search Report dated Jul. 17, 2024, issued in counterpart Application No. 23186361.4. (6 pages).
Office Action dated Jun. 17, 2025, issued in counterpart JP Application No. 2023-027880, with English translation. (8 pages).

* cited by examiner

*Primary Examiner* — Michael S Lowe
(74) *Attorney, Agent, or Firm* — WHDA, LLP

(57) ABSTRACT

A vehicle body includes a main body frame including a large plate; a pair of left and right longitudinal ribs built upright on the large plate; and a cross rib built upright on the large plate, the large plate has a cutout area provided in a rear portion, the longitudinal ribs are built upright toward a backward direction along left and right edges of the cutout area to be spaced apart in a left and right direction, and the cross rib intersects the longitudinal ribs and is built upright along a front edge of the cutout area. A counterweight is fixed to rear portions of the longitudinal ribs, and the counterweight serves as a weight balance adjusting member and a cross beam of the main body frame.

2 Claims, 4 Drawing Sheets

WORKING VEHICLE

CROSS-REFERENCE TO RELATED APPLICATION

This application is based upon and claims the benefit of priority of the prior Japanese Patent Application No. P2023-027880, filed on Feb. 27, 2023, and the entire contents of which are incorporated herein by reference.

TECHNICAL FIELD

The present invention relates to a working vehicle including a working unit working by a hydraulic pressure and an electric motor that is a drive source for the working unit.

BACKGROUND ART

As an example of a working vehicle, a hydraulic excavator, a track loader, and the like including a lower body to which driving crawlers or tires are mounted, an upper body provided on the lower body, and a working unit that is mounted to the lower body or the upper body and that works by a hydraulic pressure are known.

Recently, a working vehicle driven by an electric motor instead of a conventional engine is under development. In the electrification of the working vehicle, it is common to mount a large-sized and heavy-weight battery in a vehicle body for solving the shortage of operating time and power (refer to PTL: Japanese Patent No. 7025226).

SUMMARY OF INVENTION

Technical Problem

In the working vehicle driven by the electric motor described above as an example, maintaining enough strength in a main body frame that serves as a foundation of an upper body enables mounting of the large-sized and heavy-weight battery. However, the main body frame is formed from a plurality of plates, brackets, reinforcing members, seal members, and the like welded in a complicated fashion. Particularly in a rear portion where the battery is disposed, many components are used, involving problems of a complicated structure, worse assemblability, and increased welding man-hours.

Solution to Problem

The present invention has been accomplished under the circumstances. An object of the present invention is to provide a working vehicle capable of maintaining sufficient strength in a vehicle body to mount a heavy-weight object while achieving a simple rear portion structure of a vehicle body.

The present invention solves the problems by the following solutions.

A working vehicle has a vehicle body, a travel unit, a working unit working by a hydraulic pressure, and a drive source for the travel unit or the working unit, the vehicle body including a main body frame provided in a lower portion and serving as a reinforcing member and a support member for an on-board device, the main body frame including a large plate serving as a bottom plate; a pair of left and right longitudinal ribs built upright on the large plate; and a cross rib built upright on the large plate, the large plate has a cutout area provided in a rear portion, facing backward in a plane view, the longitudinal ribs being built upright toward a backward direction along left and right edges of the cutout area to be spaced apart in a left and right direction, and the cross rib intersecting the longitudinal ribs and being built upright along a front edge of the cutout area.

According to the above configurations, the number of reinforcing members disposed in the rear portion of the main body frame can be reduced since the longitudinal ribs function as longitudinal beams of the main body frame. That is, it is possible to provide a working vehicle capable of maintaining sufficient strength in the vehicle body to mount a heavy-weight object while achieving a simple rear portion structure of the vehicle body.

Furthermore, it is preferable that a counterweight is fixed to rear portions of the longitudinal ribs by fixing members, and that the counterweight serves as both a weight balance adjusting member for the vehicle body and a cross beam of the main body frame.

It is also preferable that the large plate has lashing points in left and right rear end portions apart from each other across the cutout area, that lashing point reinforcing members are fixedly attached onto the lashing points, and that the lashing point reinforcing members are held between the large plate and mounting seats for mounting the counterweight.

Advantageous Effects of Invention

According to the present invention, it is possible to provide a working vehicle capable of maintaining sufficient strength in a vehicle body to mount a heavy-weight object while achieving a simple rear portion structure of the vehicle body.

DESCRIPTION OF EMBODIMENTS

Figure 1:
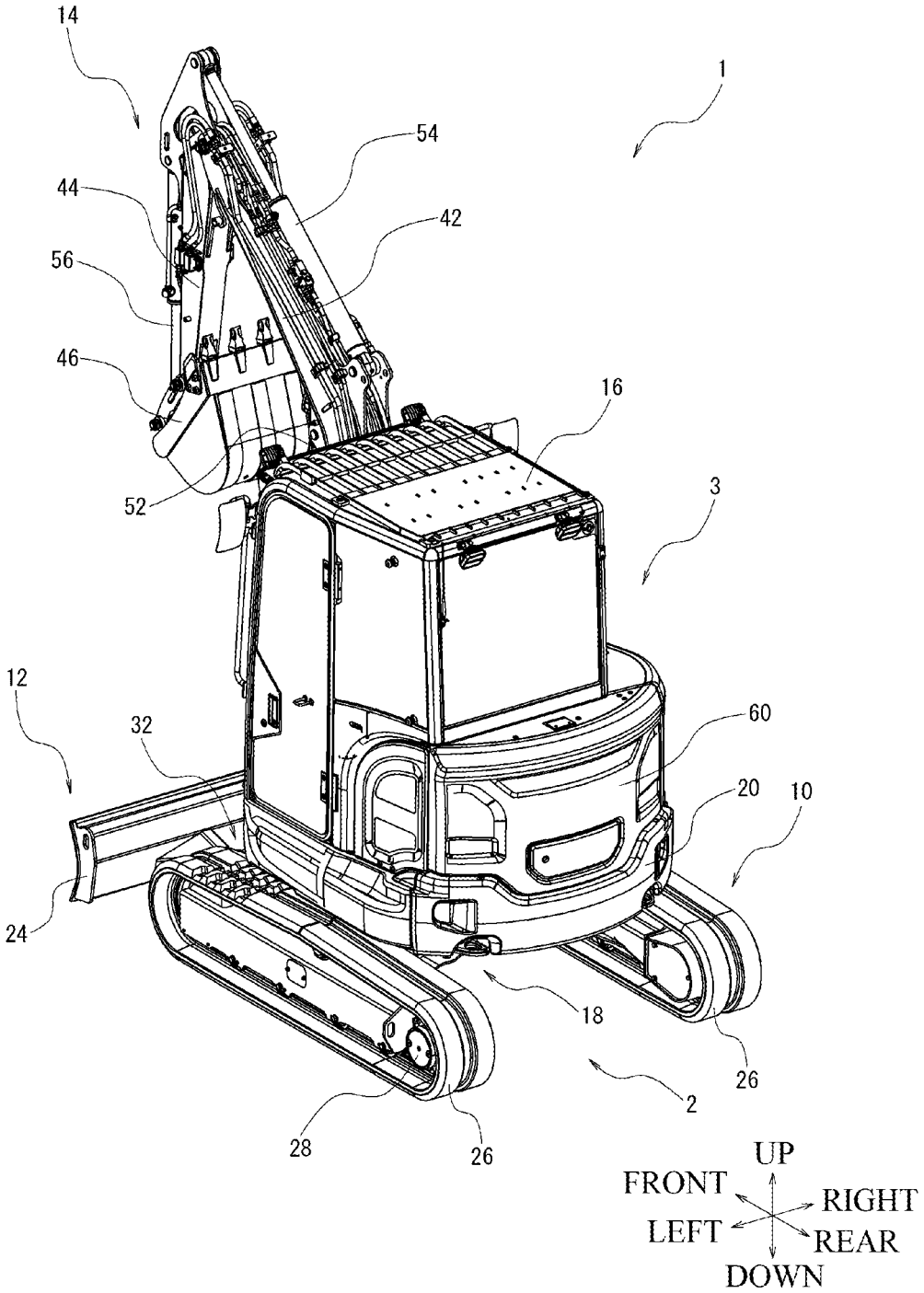
FIG. 1 is a perspective view illustrating an example of a working vehicle according to an embodiment of the present invention.

An embodiment of the present invention will be described hereinafter in detail with reference to the drawings. FIG. 1 is a schematic view illustrating an example of a working vehicle 1 according to the present embodiment (perspective view from above a left rear portion). For the sake of convenience of description, arrows may indicate up and down, front and back, and left and right directions in the drawings. In addition, members having the same function are denoted by the same reference sign and may not be repeatedly described in all the drawings for describing the embodiments.

Overall configurations of the working vehicle 1 will first be described. A hydraulic excavator will be described as an example of the working vehicle 1. However, the working vehicle 1 is not limited to the hydraulic excavator.

As illustrated in FIG. 1, the working vehicle 1 includes a lower body 2 and an upper body 3 provided on the lower body 2 as a vehicle body (the lower body 2 and the upper body 3 may be configured as one piece).

The working vehicle 1 includes working units 12 and 14 mounted to the lower body 2 or the upper body 3 and worked by a hydraulic pressure (hydraulic oil at a predetermined pressure). The lower body 2 includes a travel unit 10 that travels. The upper body 3 includes a cab 16 provided in a front portion and in which operating units for an operator to operate traveling and working are provided. Detailed configurations of the upper body 3 will be described later.

The lower body 2 includes a pair of left and right crawlers (tracks) 26 as an example of the travel unit 10. However, the travel unit 10 is not limited to the crawlers 26. As another example, the working vehicle 1 may include tires (not illustrated) instead of the crawlers 26. The crawlers 26 are each driven (to travel) by a hydraulic travel motors 28.

The working vehicle 1 includes a blade 24 as an example of the working unit 12. The blade 24 is mounted to the lower body 2 in such a way as to be able to swing upward and downward (including forward and backward components). The blade 24 is driven by a hydraulic cylinder (blade cylinder) 32. However, the working unit 12 is not limited to the above configurations.

The working vehicle 1 includes a boom 42, an arm 44, and an attachment (a bucket in the present embodiment) 46 as an example of the working unit 14. However, the attachment 46 is not limited to the bucket. The boom 42 is mounted to the upper body 3 in such a way as to be able to swing upward and downward (including forward and backward components). In the present embodiment, a boom bracket (not illustrated) is provided between the upper body 3 and the boom 42. The boom bracket enables the boom 42 to swing to left and right (including forward and backward components) in reaction to the upper body 3. It is noted that the boom bracket may be omitted. The arm 44 is mounted to the boom 42 in such a way as to be able to swing upward and downward (including forward and backward components). The attachment 46 is mounted to the arm 44 in such a way as to be able to swing upward and downward (including forward and backward components). The boom 42 is driven by a hydraulic cylinder (boom cylinder) 52. The arm 44 is driven by a hydraulic cylinder (arm cylinder) 54. The attachment 46 is driven by a hydraulic cylinder (bucket cylinder) 56. However, the working unit 14 is not limited to the above configurations.

A driving mechanism for driving the hydraulic travel motors 28 and the hydraulic cylinders is configured from a hydraulic pump driven by a drive source, a control valve, and the like (all of which are not illustrated). The control valve is actuated by an operator operating the operating units to exercise control to supply hydraulic oil at a predetermined pressure delivered from the hydraulic pump to the hydraulic travel motors 28 and the hydraulic cylinders. This allows for the travel unit 10 to travel and for the working units 12 and 14 to work. One or a plurality of hydraulic pumps configuring the driving mechanism are provided depending on configurations, loads, and the like of the working units 12 and 14 and the travel unit 10.

In the present embodiment, the working vehicle 1 includes an electric motor (not illustrated) as the drive source. One or a plurality of electric motors configuring the drive source are provided depending on the number, rated output power, and the like of the hydraulic pumps. As another example of the drive source, the drive source may be configured to use not only the electric motor but an engine (not illustrated).

The working vehicle 1 also includes an on-board charger 62 that supplies electric power to the electric motor. The electric power output from the on-board charger 62 is supplied to the electric motor via a battery pack 64 and an inverter (not illustrated). The battery pack 64 includes a first rechargeable battery (e.g., lithium-ion rechargeable battery) that stores the supplied electric power, a control section controlling the supply of the electric power to the electric motor and the rechargeable battery (first rechargeable battery), and the like (all of which are not illustrated). A second rechargeable battery (e.g., lead-acid rechargeable battery) and switches (controllers) are connected to the battery pack 64 (all of which are not illustrated).

Other mechanisms for traveling and working in the working vehicle 1 according to the present embodiment are similar to those in a well-known working vehicle (hydraulic excavator) and not described in detail.

Figure 2:
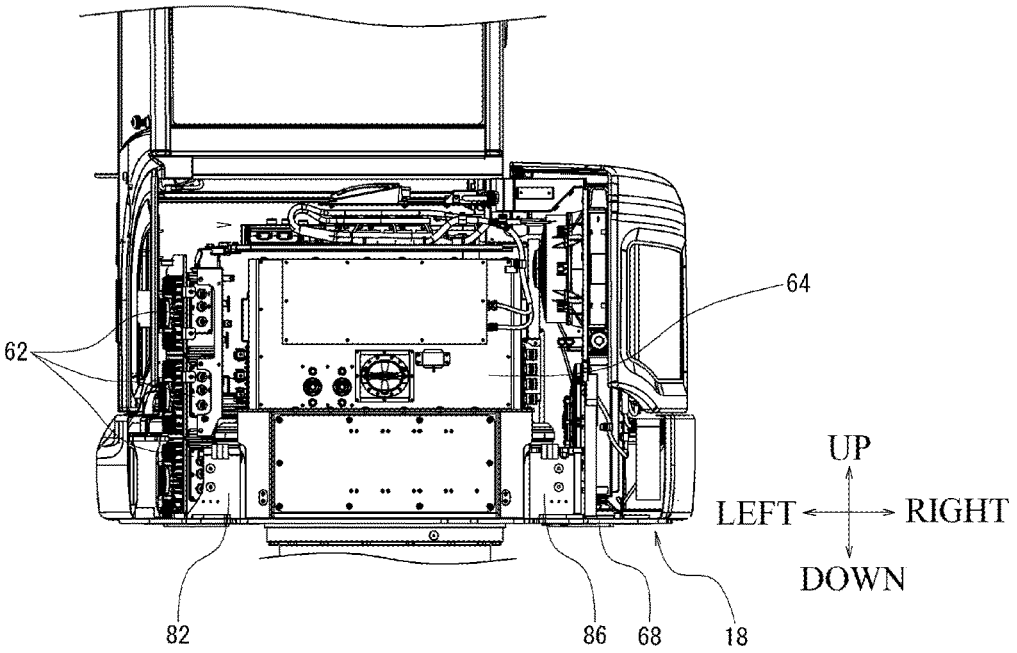
FIG. 2 is a back view of the working vehicle illustrated in FIG. 1.

Configurations of the upper body 3 will next be described in detail. FIG. 2 is a back view illustrating a rear portion structure of the working vehicle 1 (with a battery cover 60 and a counterweight 20 not illustrated). The upper body 3 includes a main body frame 18 in a lower portion. The main body frame 18 serves as both a reinforcing member for the upper body 3 and a support member for on-board devices. The upper body 3 includes the battery pack 64 mounted to the main body frame 18 and supplying electric power to the electric motor. The upper body 3 includes the counterweight 20 mounted to the main body frame 18 and maintaining a weight balance of a vehicle body.

Figure 3:
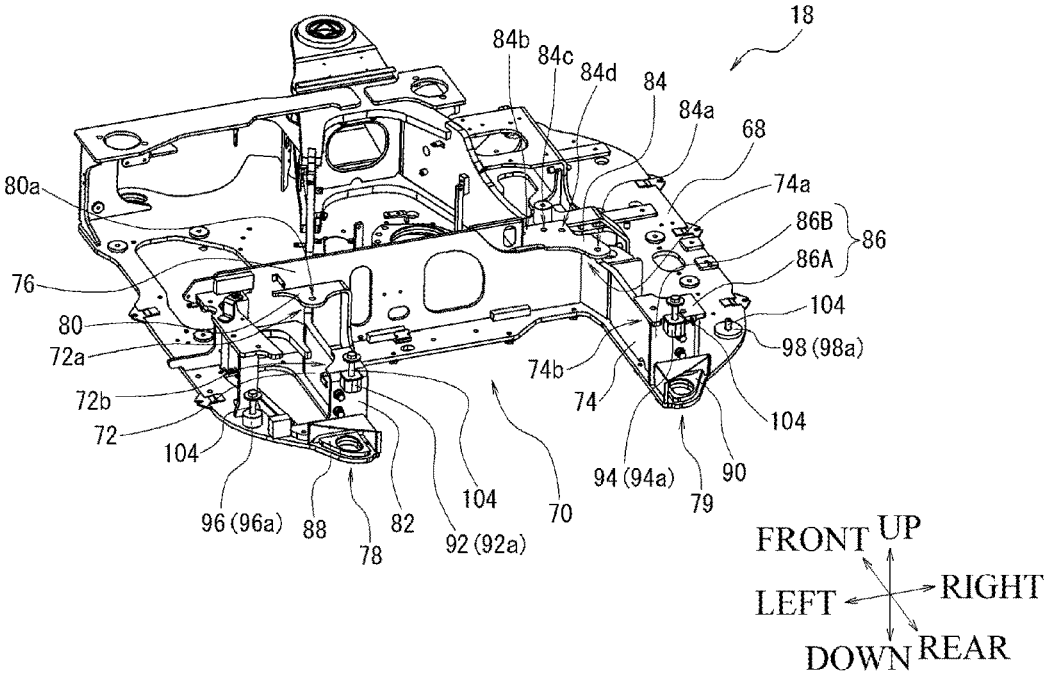
FIG. 3 is a perspective view of a main body frame of the working vehicle illustrated in FIG. 1.
Figure 4:
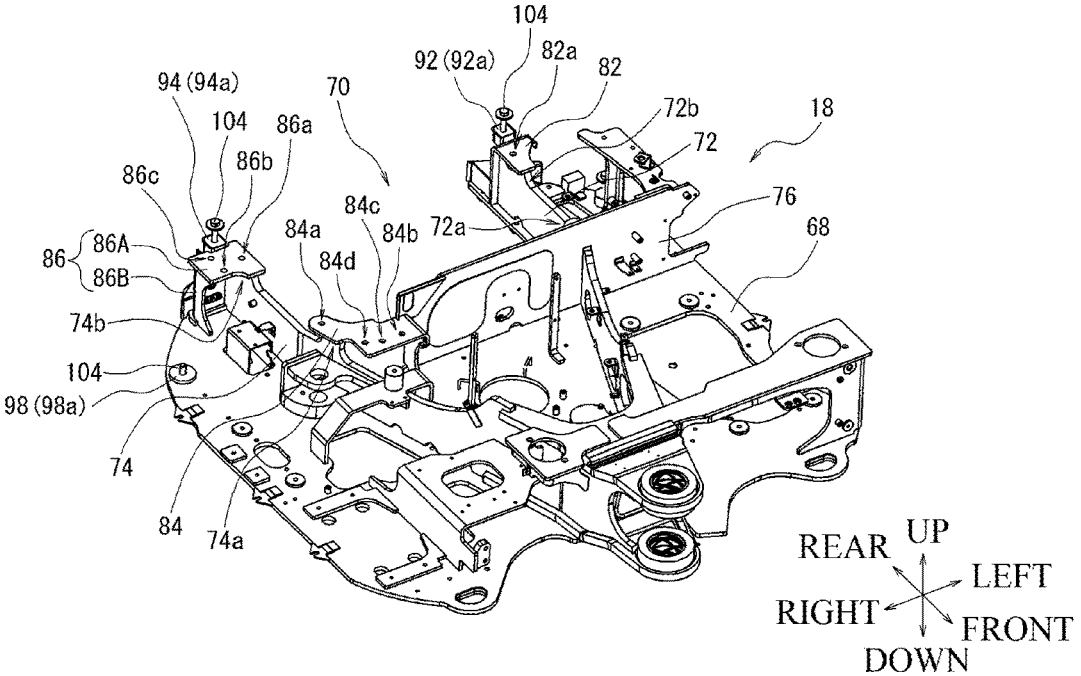
FIG. 4 is a perspective view of the main body frame illustrated in FIG. 3 from a different direction.
Figure 5:
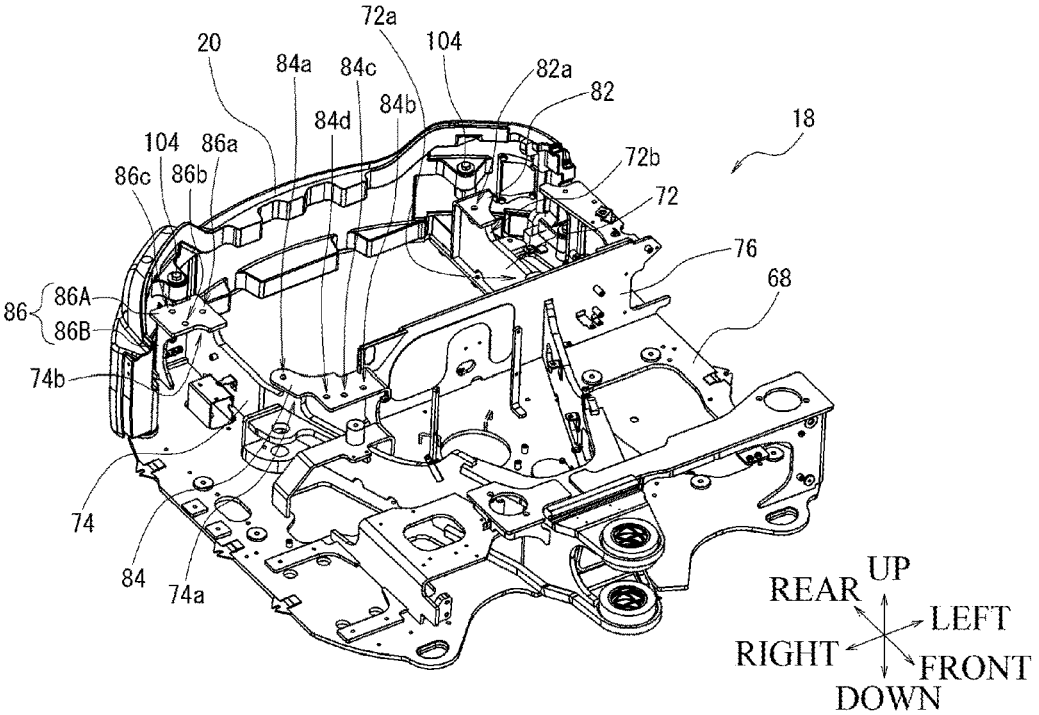
FIG. 5 is a perspective view of a state of mounting a counterweight in the main body frame illustrated in FIG. 4.

As illustrated in FIGS. 3 and 4, the main body frame 18 is formed from plates, beams, and the like worked into predetermined shapes and welded integrally. Specifically, the main body frame 18 includes a large plate 68, longitudinal ribs 72, 74, and a cross rib 76.

The large plate 68 is a plate that serves as a bottom plate of the main body frame 18. The large plate 68 has a cutout area 70 in a rear portion. The cutout area 70 faces backward direction in a plane view. The large plate 68 has lashing points (mechanisms for locking binding members 110 used to prevent accidental movement such as rolling and falling during transport or parking of the working vehicle 1) 78, 79 in left and right rear end portions apart from each other across the cutout area 70. Lashing point reinforcing members 88, 90 are fixedly attached onto the lashing points 78, 79, respectively. The longitudinal ribs 72, 74 are built upright as a pair of left and right ribs so that the longitudinal ribs 72, 74 extend backward on the large plate 68 in a forward and backward direction from a front portion of the large plate 68 as a starting point along left and right edges of the cutout area 70 to be spaced apart in a left and right direction. The cross rib 76 intersects the longitudinal ribs 72, 74 and is built upright to extend on the large plate 68 in the left and right direction along a front edge of the cutout area 70.

According to the above configurations, the number of reinforcing members disposed in the rear portion of the main body frame 18 can be reduced and simplified since the longitudinal ribs 72, 74 function as longitudinal beams of the main body frame 18. Furthermore, it is possible to maintain sufficient strength in the vehicle body (upper body 3 in the present embodiment) to mount a heavy-weight object.

A mounting structure of the battery pack 64 and the counterweight 20 will next be described.

The longitudinal rib 72 includes a first mounting seat 80 for mounting the battery pack 64 and a second mounting seat 82 for mounting the battery pack 64 and the counterweight 20. The longitudinal rib 74 includes a third mounting seat 84 for mounting the battery pack 64, a floor frame (not illustrated), and a hydraulic oil tank (not illustrated) and a fourth mounting seat 86 for mounting the battery pack 64, the floor frame, and the counterweight 20.

As an example, the first mounting seat 80 is a generally L-shaped plate in a front view, which extends right from a protruding portion 72*a* of the longitudinal rib 72 and then bends and extends generally at a right angle from an end portion of the extension in a downward direction (toward the large plate 68), with a front portion of the first mounting seat 80 abutting on a rear surface of the cross rib 76. The first mounting seat 80 has one mounting hole (screw hole) 80*a* on an upper surface. However, configurations of the first mounting seat 80 are not limited to these configurations.

As an example, the second mounting seat 82 is a generally L-shaped plate in a side view, which extends backward from a protruding portion 72*b* of the longitudinal rib 72 and then bends and extends generally at a right angle from an end portion of the extension along a rear end of the longitudinal rib 72. The second mounting seat 82 has one mounting hole (screw hole) 82*a* on an upper surface. The second mounting seat 82 also includes a first counterweight mounting section 92 for mounting the counterweight 20. The first counterweight mounting section 92 has one mounting hole (screw hole) 92*a*. However, configurations of the second mounting seat 82 are not limited to these configurations.

As an example, the third mounting seat 84 is a generally L-shaped plate in a front view, which extends ahead of a protruding portion 74*a* of the longitudinal rib 74 on the left to stride over the cross rib 76 and then bends and extends generally at a right angle from an end portion of the extension downward (toward the large plate 68). The third mounting seat 84 has one mounting hole (screw hole) 84*a* for mounting the battery pack 64 and three mounting holes (screw holes) 84*b*, 84*c*, 84*d* for mounting the floor frame and the hydraulic oil tank on an upper surface. However, configurations of the third mounting seat 84 are not limited to these configurations.

As an example, the fourth mounting seat 86 includes an upper plate 86A mounted to a protruding portion 74*b* of the longitudinal rib 74 and a generally L-shaped lower plate 86B in a plane view that supports the upper plate 86A from below. The fourth mounting seat 86 (upper plate 86A) has one mounting hole (screw hole) 86*a* for mounting the battery pack 64 and two mounting holes (screw holes) 86*b*, 86*c* for mounting the floor frame on an upper surface. The fourth mounting seat 86 also includes a second counterweight mounting section 94 for mounting the counterweight 20. The second counterweight mounting section 94 has one mounting hole (screw hole) 94*a*. However, configurations of the fourth mounting seat 84 are not limited to these configurations.

Figure 6B:
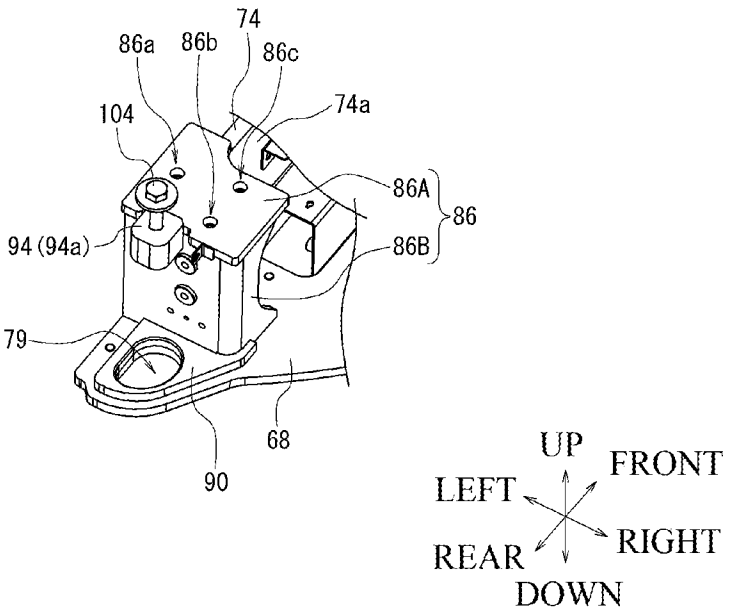
FIG. 6B is an enlarged view of a fourth mounting seat illustrated in FIG. 3.
Figure 6A:
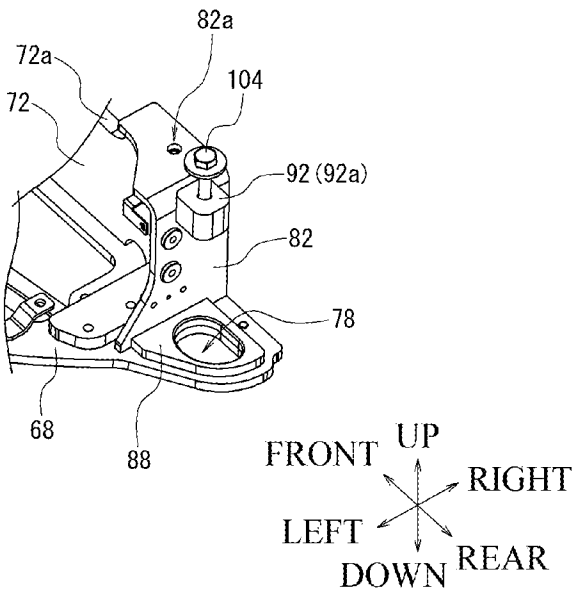
FIG. 6A is an enlarged view of a second mounting seat illustrated in FIG. 3.

Here, as illustrated in FIGS. 6A and 6B, the mounting seats 82, 86 are mounted to the large plate 68 by intersecting front portions of the lashing point reinforcing members 88, 90. That is, the lashing point reinforcing members 88, 90 are in a state of being held between the large plate 68 and the mounting seats 82, 86. This can prevent bending or breakage damage to the large plate 68 due to the pulling of the binding members.

The battery pack 64 includes a bracket (not illustrated) protruding from left and right side surfaces. The bracket is fixed to the mounting seats 80 (mounting hole 80*a*), 82 (mounting hole 82*a*), 84 (mounting hole 84*a*), 86 (mounting hole 86*a*) by rubber vibration insulators (not illustrated) and fixing members (not illustrated). This enables the battery pack 64 to be mounted to the longitudinal ribs 72, 74 (main body frame 18). Since being firmly fixed to the longitudinal ribs 72, 74 by welding, the mounting seats 80, 82, 84, 86 can support the large-sized and heavy-weight battery pack 64.

The battery pack 64 mounted to the main body frame 18 is located upward of the cutout area 70. Moreover, the cutout area 70 is formed such that at least a location in front of the center of gravity in the battery pack 64 is exposed in a bottom view. With this structure, a support section (claw in a forklift) of a cargo-carrying machine such as the forklift can be advanced from a rear portion of the vehicle body to load/unload the battery pack 64. That is, this can facilitate the attachment/detachment of the battery pack 64.

The counterweight 20 is fixed to the counterweight mounting sections 92 (mounting hole 92*a*), 94 (mounting hole 94*a*) described above by fixing members (e.g., bolts) 104 to allow the counterweight 20 to be mounted to the longitudinal ribs 72, 74 (main body frame 18). This enables the counterweight 20 to be connected to the longitudinal ribs 72, 74 and to serve as not only a weight balance adjusting member but also a cross beam of the vehicle body (upper body 3), increasing the strength of the vehicle body (upper body 3). The counterweight 20 is also fixed to a third counterweight mounting section 96 (mounting hole 96*a*) and a fourth counterweight mounting section 98 (mounting hole 98*a*) provided on the large plate 68 by the fixing members 104 to allow the counterweight 20 to be mounted to the large plate 68 (main body frame 18).

It is noted that the counterweight 20 is fixed to the three counterweight mounting sections 92, 94, 96 by penetrating the fixing members 104 into the counterweight mounting sections 92, 94, and 96 from above. The counterweight 20 is fixed to one counterweight mounting section 98 by penetrating the fixing member 104 into the counterweight mounting section 98 from below. In the conventional working vehicle, a plurality of locations (e.g., two locations) of the counterweight are fixed from above and a plurality of other locations (e.g., two locations) thereof are fixed from below. According to the present embodiment, by contrast, only one location is fixed from below, eliminating time and labor for accessing the lower mounting section.

As described so far, according to the present invention, it is possible to provide a working vehicle capable of maintaining sufficient strength in a vehicle body to mount a heavy-weight object while achieving the simple rear portion structure of the vehicle body (upper body 3).

While the working vehicle using the electric motor as the drive source has been described as an example of the working vehicle 1, the present invention is not limited to this example and is also applicable to a working vehicle using an engine (internal combustion engine) as a drive source. In particular, the working vehicle can be configured to mount other devices, an additional counterweight, and the like other than the battery pack in the rear portion of the vehicle body.

The present invention is not limited to the above example (hydraulic excavator). The present invention is similarly applicable to other working vehicles (e.g., a track loader and a tracked dumper).

What is claimed is:

1. A working vehicle having a vehicle body, a travel unit, a working unit working by a hydraulic pressure, and a drive source for the travel unit or the working unit, wherein the vehicle body comprises a main body frame provided in a lower portion and serving as a reinforcing member and a support member for an on-board device, and a counterweight mounted to the main body frame, wherein the main body frame comprises a large plate serving as a bottom plate; a pair of left and right longitudinal ribs built upright on the large plate; and a cross rib built upright on the large plate, wherein the large plate has a cutout area provided in a rear portion, facing backward in a plane view, wherein the longitudinal ribs are built upright toward a backward direction along left and right edges of the cutout area to be spaced apart in a left and right direction, wherein the cross rib intersects the longitudinal ribs and is built upright along a front edge of the cutout area, wherein the counterweight is directly fixed to a third counterweight mounting section and a fourth counterweight mounting section provided on the large plate by fixing members to allow the counterweight to allow the counterweight to be fixed to the large plate, and also wherein the counterweight is fixed to a first counterweight mounting section and a second counterweight mounting section by fixing members to allow the counterweight to be mounted to the longitudinal ribs, the first counterweight mounting section and the second counterweight mounting section being provided to rear portions of the respective longitudinal ribs, be mounted to the large plate, wherein the counterweight is fixed to one of the first, second, third, and fourth counterweight mounting sections by penetrating the fixing member into the one from below, and the counterweight is fixed to the others by penetrating the fixing members into the others from above, and wherein the counterweight serves as both a weight balance adjusting member for the vehicle body and a cross beam of the main body frame.

2. The working vehicle according to claim 1, wherein the large plate has lashing points in left and right rear end portions apart from each other across the cutout area, the lashing points are for locking binding members used to prevent accidental movement including rolling and falling during transport or parking of the working vehicle, lashing point reinforcing members are fixedly attached onto the lashing points, and wherein the lashing point reinforcing members are held between the large plate and mounting seats for mounting the counterweight.

* * * * *